US009008325B2

(12) United States Patent
Saltykov

(10) Patent No.: US 9,008,325 B2
(45) Date of Patent: Apr. 14, 2015

(54) METHOD FOR DETERMINING THE SOUND PRESSURE LEVEL AT THE EARDRUM OF AN OCCLUDED EAR

(71) Applicant: Oleg Saltykov, Fairlawn, NJ (US)

(72) Inventor: Oleg Saltykov, Fairlawn, NJ (US)

(73) Assignee: Siemens Medical Instruments Pte. Ltd., Singapore (SG)

( * ) Notice: Subject to any disclaimer, the term of this patent is extended or adjusted under 35 U.S.C. 154(b) by 332 days.

(21) Appl. No.: 13/710,961

(22) Filed: Dec. 11, 2012

(65) Prior Publication Data

US 2014/0161267 A1 Jun. 12, 2014

(51) Int. Cl.
*H04R 29/00* (2006.01)
*H04R 25/00* (2006.01)

(52) U.S. Cl.
CPC ..... *H04R 25/30* (2013.01); *H04R 25/70* (2013.01)

(58) Field of Classification Search
None
See application file for complete search history.

(56) References Cited

U.S. PATENT DOCUMENTS

| | | | | |
|---|---|---|---|---|
| 8,542,841 | B2 * | 9/2013 | LoPresti et al. | 381/60 |
| 8,571,224 | B2 * | 10/2013 | Recker et al. | 381/56 |
| 2007/0009107 | A1 * | 1/2007 | Lange | 381/60 |
| 2010/0202642 | A1 | 8/2010 | LoPresti | |
| 2011/0182453 | A1 * | 7/2011 | Van Hal et al. | 381/328 |

FOREIGN PATENT DOCUMENTS

| | | |
|---|---|---|
| EP | 2207366 | 7/2010 |
| WO | 2010016925 | 2/2010 |

OTHER PUBLICATIONS

Munro Kevin J. et al; "Measuring the Real-Ear to Coupler Difference Transfer Function with an Insert Earphone and a Hearing Instrument: Are They the Same?"; Ear and Hearing; vol. 26; No. 1; pp. 27-34, (2005).

Chan Joseph C. K. et al; "Estimation of eardrum acoustic pressure and of ear canal length from remote points in the canal"; The Journal of the Acoustical Society of America, American Institute of Physics for the Acoustical Society of America, NY; vol. 87; No. 3; pp. 1237-1247 , Mar. 1990.

Saltykov Oleg et al; "Potential Errors of Real-Ear-to-Coupler-Difference Method Applied for a Prediction of Hearing Aid Performance in an Individual Ear"; 47th International Conference: Music Induced Hearing Disorders; pp. 1-8 , Jun. 2012.

EP Search Report in Application No. 13196500.6 dated Feb. 17, 2014, 8 pages.

* cited by examiner

*Primary Examiner* — Paul Huber
(74) *Attorney, Agent, or Firm* — Peter Kendall

(57) ABSTRACT

The sound pressure level at the eardrum may be determined by constructing an optimized model of the ear canal and then calculating the simulated sound pressure level at the eardrum. The model is obtained by comparing real-ear-to-coupler differences between the sound pressure level measured at a fixed distance from a hearing instrument and a simulation of the measurement, optimizing the model by varying the length and/or diameter of the canal model, repeating the simulation and determination of simulated real-ear-to-coupler difference until the differences between the measured and simulated values are minimized. The optimized real-ear-to-coupler difference at the eardrum may then be determined and in turn the sound pressure level at the eardrum may be calculated. The sound pressure level at the eardrum may then be used to acoustically fit the hearing instrument to the person.

14 Claims, 8 Drawing Sheets

L length of the ear canal
D diameter of the ear canal
l distance of the probe 50 from the sound tube L length of the ear canal
D diameter of the ear canal
l distance of the probe 50 from the sound tube

METHOD FOR DETERMINING THE SOUND PRESSURE LEVEL AT THE EARDRUM OF AN OCCLUDED EAR

BACKGROUND AND SUMMARY OF THE INVENTION

A knowledge of the sound pressure level at the eardrum over the audible frequency range is desirable to acoustically fit a hearing instrument to a user's ear. The sound pressure level may be determined by using real ear-to-coupler difference techniques to create an acoustic model of the user's ear canal.

DESCRIPTION OF THE INVENTION

To determine the sound pressure level at the eardrum of an occluded ear, the sound pressure level is measured in the user's ear canal at a predetermined distance from the end of the sound tube of a hearing instrument over the desired range of frequencies and then normalized using the frequency response detected in a test coupler to obtain the measured real-ear-to-coupler difference at the predetermined distance from the end of the sound tube. The sound pressure level is then simulated in a model of the user's ear canal, again over the desired range of frequencies, and once again normalized using a model of a test coupler, yielding a simulated real-ear-to-coupler difference at the predetermined distance from the end of the sound tube. Using an optimization procedure, the dimensions of the ear canal model are adjusted until the differences between the measured and the simulated values are minimized to a predetermined, acceptable amount. The optimized model of the ear canal is then used to obtain the real-ear-to-coupler difference at the eardrum or tympanic membrane. In turn, this parameter may be used to calculate the sound pressure level at the eardrum.

Measuring the Sound Pressure Level

Figure 1:
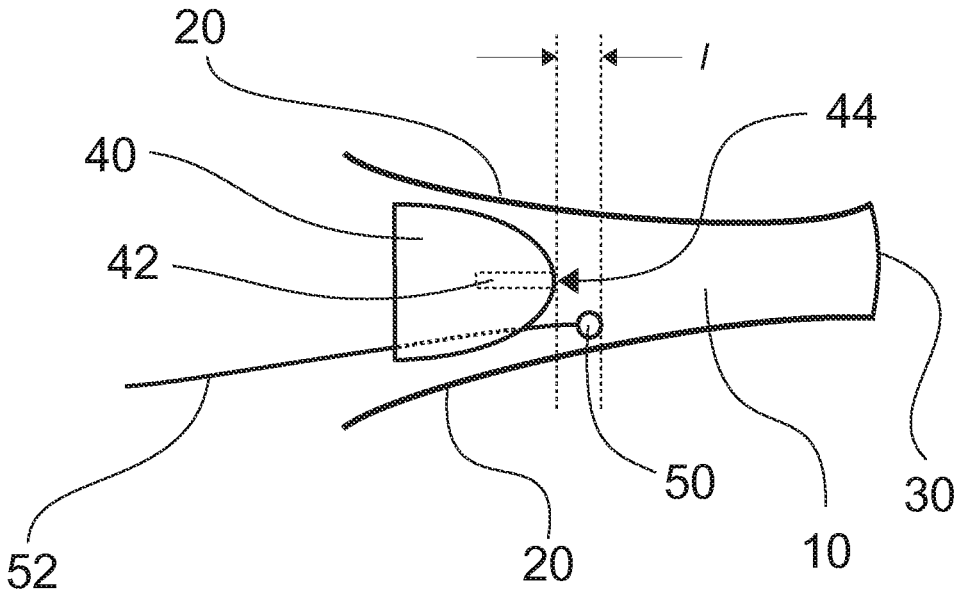
FIG. 1 is a schematic representation of a hearing instrument and probe microphone positioned in an ear canal.
Figure 2:
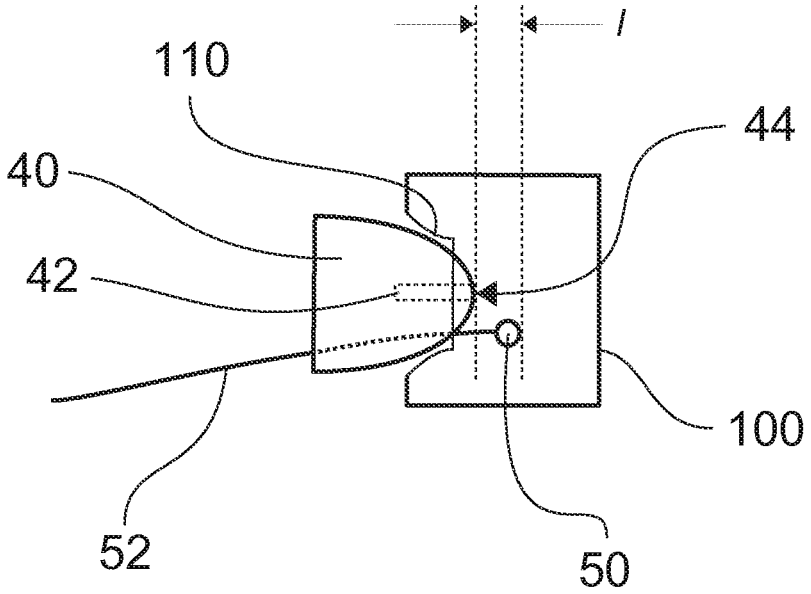
FIG. 2 is a schematic representation of a hearing instrument and probe microphone positioned in a test coupler.

As illustrated in FIG. 1, the sound pressure level in the ear canal 10 is measured using a hearing instrument 40 to generate sound and a probe microphone 50 to detect the generated sound. The hearing instrument 40 resides in the ear canal 10 between the ear canal walls 20, facing the eardrum or tympanic membrane 30. In FIGS. 1 and 2, a connecting cable 52 for the probe microphone 50 is shown in phantom, passing through the body of the hearing instrument 40, but it may be located in a channel on the exterior surface of the hearing instrument 40 or in a passage within the hearing instrument 40 (neither shown).

Figure 5:
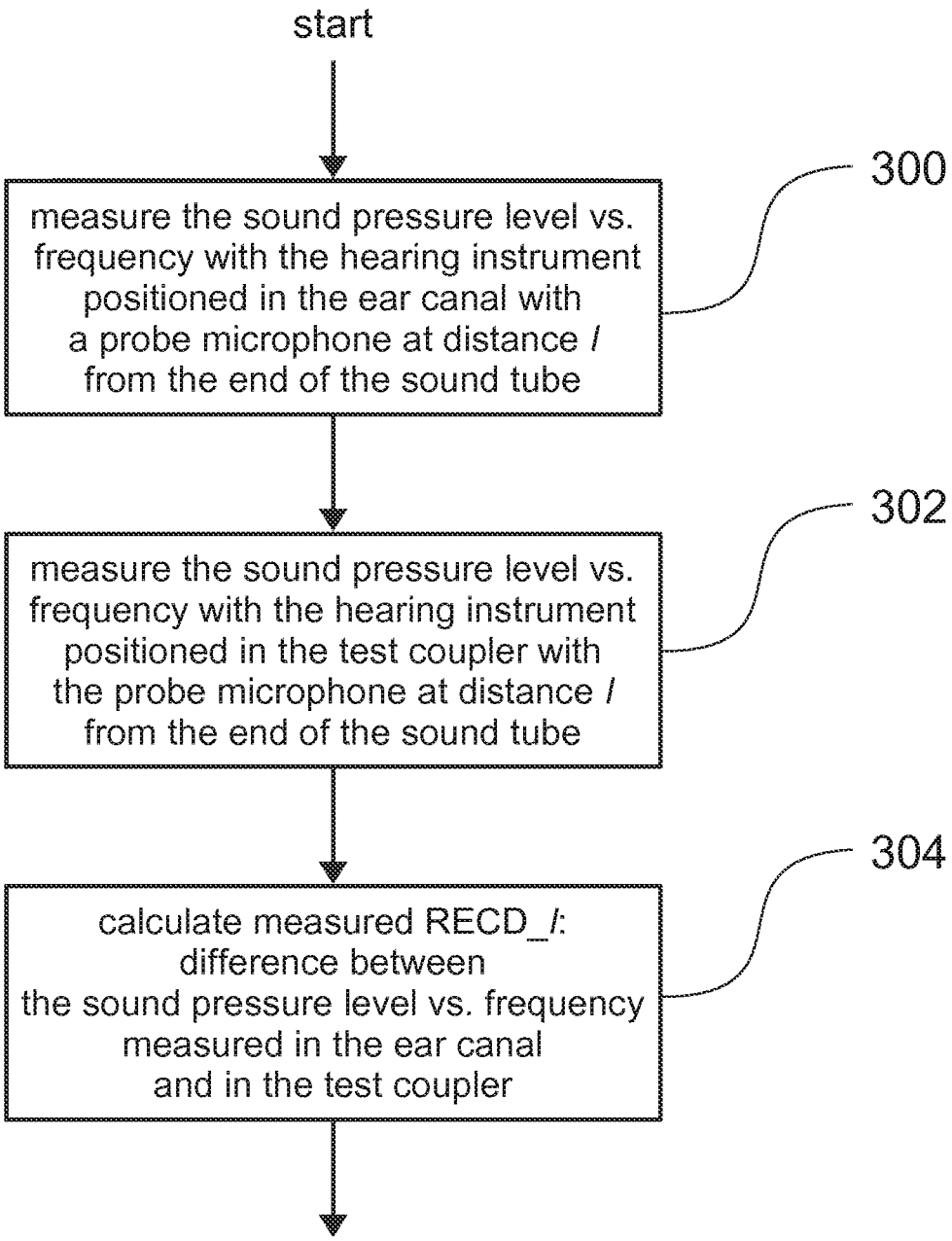
FIGS. 5-9 are flow charts of procedures for acoustically fitting a hearing instrument.

To minimize the near-field effects of the hearing instrument 40 on the generated sound, the probe microphone 50 is set apart and at a distance l from the end 44 of the hearing instrument sound tube 42 at the tip of the hearing instrument 40. A suitable distance is 5 mm (see U.S. Pat. App'n Pub. No. 2010/0202642, LoPresti et al., "Method to Estimate the Sound Pressure Level at Eardrum Using Measurements Away from the Eardrum"). Sound is then generated over the desired range of frequencies $f_1$-$f_2$ and the sound pressure level vs. frequency is measured using the probe microphone 50 (FIG. 5, step 300).

Next, the hearing instrument 40 and the probe microphone 50 are inserted into the receptacle 110 of the test coupler 100 in FIG. 2. Where high frequencies are of interest (greater than 8 kHz), the test coupler 100 may have a volume of 0.4 cc. In a test coupler of this volume, the sound pressure level is assumed to be uniform throughout. Using the same offset of distance l for the probe microphone 50, the sound pressure level is again measured (using the probe microphone 50) over the same range of frequencies $f_1$-$f_2$, yielding a frequency response for the instrument 40 (FIG. 5, step 302).

Determining Measured RECD_l

The measurements in the ear canal 10 and the test coupler 100 are used to determine or calculate measured real-ear-to-coupler difference at the predetermined distance from the end 44 of the sound tube 42 at the tip of the hearing instrument, defined as the measured RECD_l. The real-ear-to-coupler difference, a parameter known to those in the hearing instrument art, is the difference between the results of the two measurements (FIG. 5, step 304).

Simulating the Ear Canal

Figure 3:
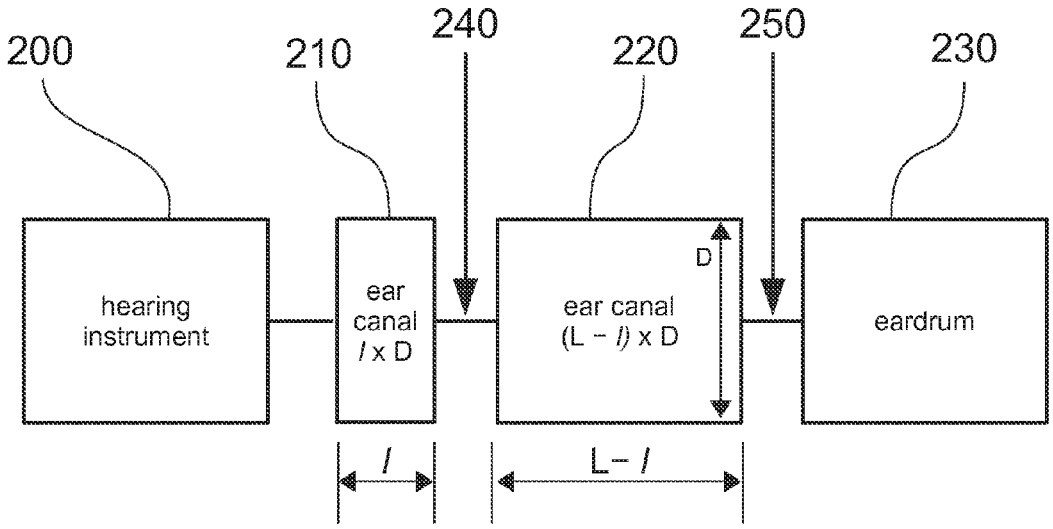
FIG. 3 is a schematic block diagram of a simulated hearing instrument, ear canal, and eardrum.

Analog models, previously created and available in the literature, are obtained for the hearing instrument 40, the ear canal 10, and the eardrum 30, and are shown in the block schematic diagram of FIG. 3 (see, e.g., LoPresti, "Electrical Analogs for Knowles Electronics, LLC. Transducers," Version 9.0, Aug. 14, 2007). The hearing instrument model 200 is followed by a model of the ear canal divided into two parts: (1) a first segment 210 having dimensions l×D, where l is the distance separating the probe microphone 50 from the end 44 of the hearing instrument sound tube 42 in FIGS. 1 and 2, and D is the diameter of the ear canal model; and (2) a second segment 220, having a length of L−l and diameter D, where L represents the overall length of the ear canal 10. A typical ear canal has a length L of 13 mm and a diameter D of 7.5 mm. The ear canal segments 210 and 220 are followed by a model of the eardrum 230 having a predetermined value of acoustic impedance.

Simulated RECD_l

Figure 4:
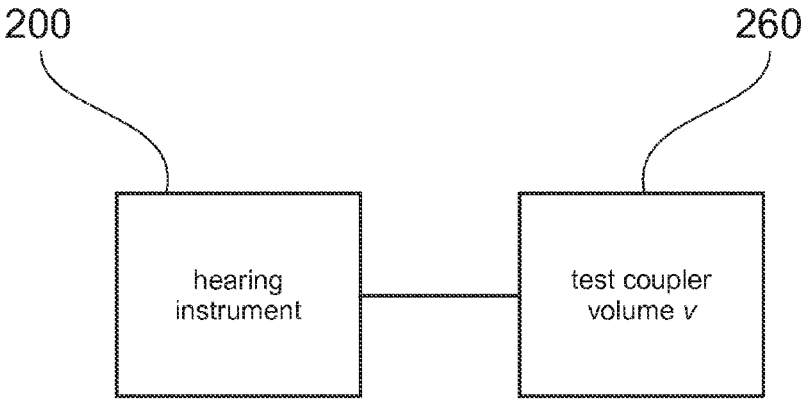
FIG. 4 is a schematic block diagram of a simulated hearing instrument and test coupler.
Figure 6:
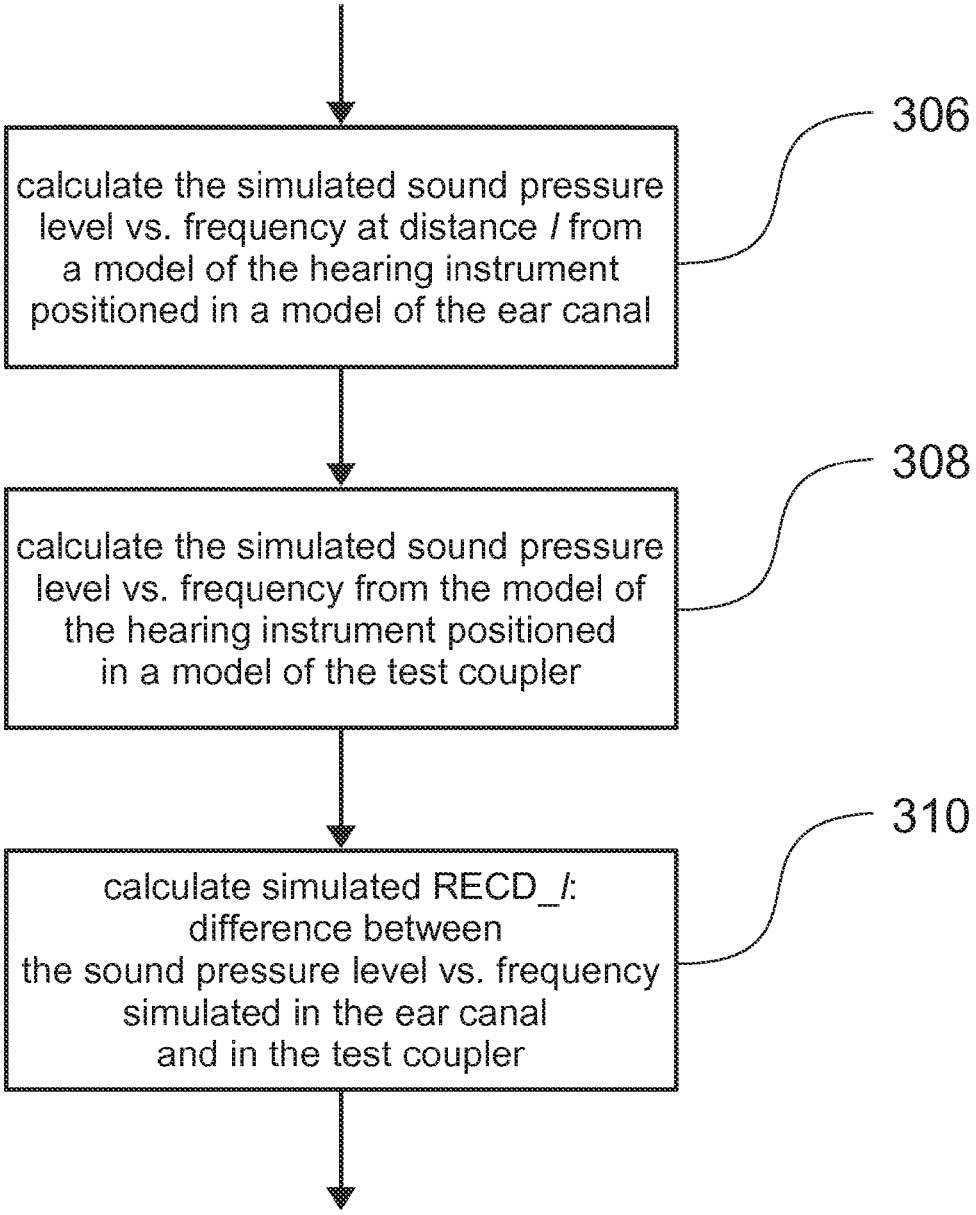

Using the model in FIG. 3, the sound pressure level is simulated over the desired frequency range $f_1$-$f_2$, at pick off point 240, which represents the position of the probe microphone 50 employed to measure the sound pressure level in the person's ear canal 10 in FIG. 1 (FIG. 6, step 306). A model of the test coupler 260 having a volume v (e.g., 0.4 cc), shown in FIG. 4 and now connected to the hearing instrument model 200, is used to simulate the sound pressure level in the test coupler 100 of FIG. 2, again over the frequency range $f_1$-$f_2$ (FIG. 6, step 308). The difference between the results of the two simulations (the ear canal and test coupler models) yields a simulated real-ear-to-coupler difference at the predetermined distance from the end 44 of the sound tube 42, defined as the simulated RECD_l (FIG. 6, step 310).

Optimizing the Ear Canal Model

Figure 7:
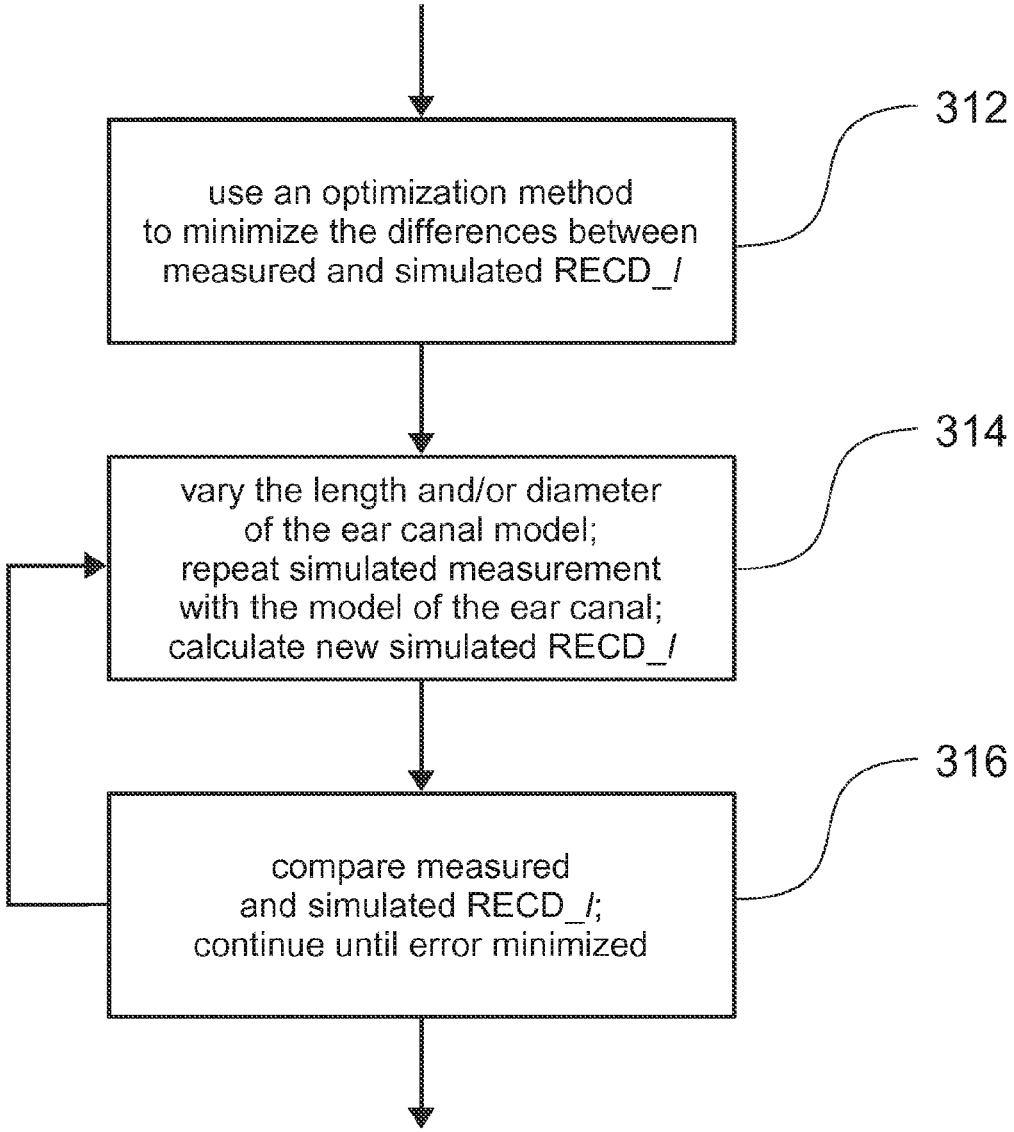

To arrive at an optimized model of the ear canal, any suitable optimization technique may be employed to minimize the differences between the measured and simulated real-ear-to-coupler difference at the predetermined distance from the end 44 of the sound tube 42 (simulated RECD_l) (FIG. 7, steps 312-316). Parameters L and D are varied and the simulations are repeated iteratively until a predetermined amount of acceptable error (or difference) has been reached (FIG. 7, steps 314-316). The optimized values of L and D represent a model (210-220-230) closest in simulated real-ear-to-coupler difference (simulated RECD_l) at the predetermined distance from the end 44 of the sound tube 42 over the desired frequency range to the measured RECD_l for the ear canal 10.

Simulating RECD at the Eardrum

Figure 8:
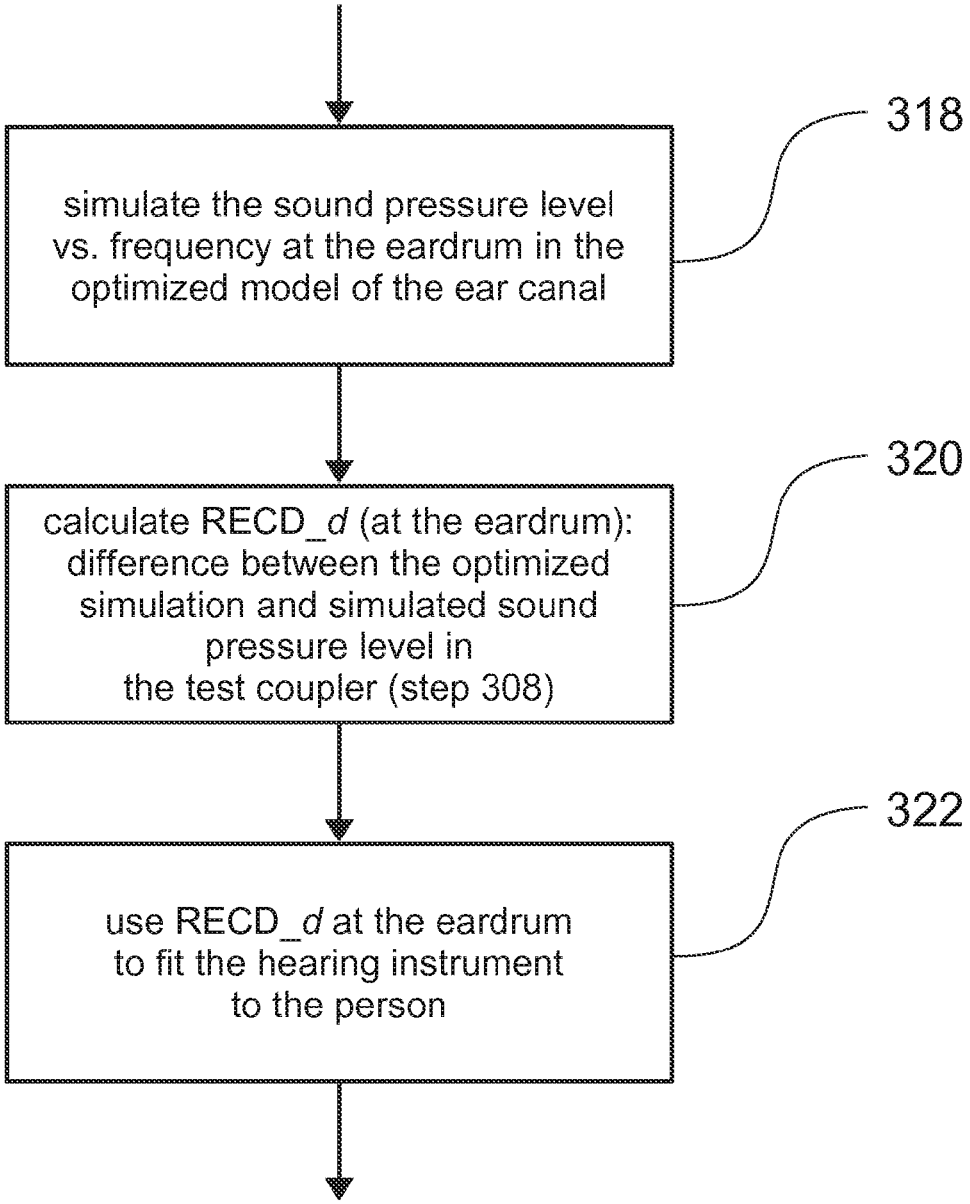

Using the optimized model (by selecting the optimized values of L and D), the sound pressure level over the frequency range is simulated using the model in FIG. 3, but taking the simulated value at pick off point 250, which represents the location of the eardrum 230 (FIG. 8, step 318). The simulated real-ear-to-coupler difference at the eardrum 230, defined as the simulated RECD_d, is obtained by subtracting the results of the simulation employing the model of the test coupler 260 (FIG. 6, 308; FIG. 8, step 320).

Calculating the Sound Pressure Level at the Eardrum

Figure 9:
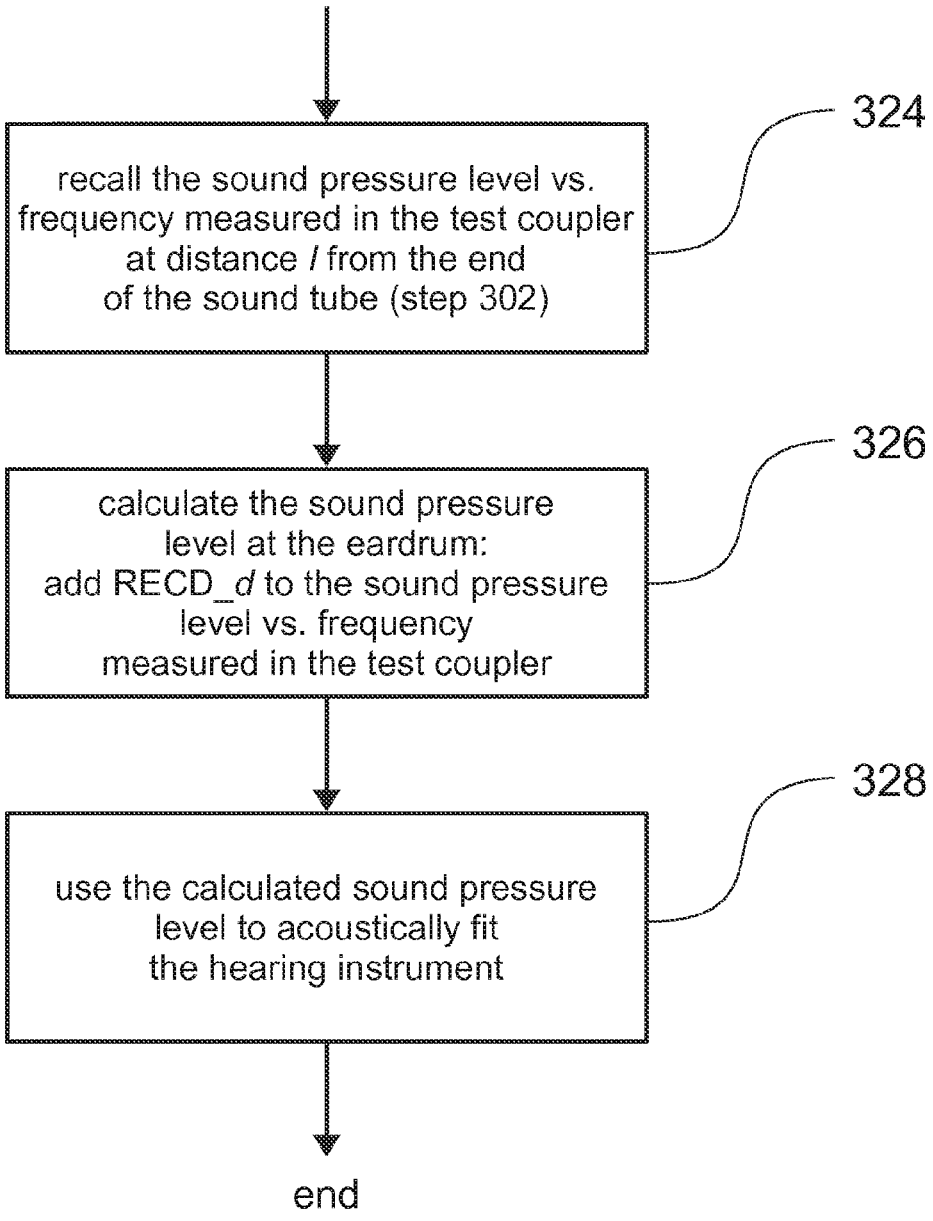

The simulated RECD_d may now be used to acoustically fit the hearing instrument to the user (FIG. 8, step 322). This parameter, RECD_d, is added to the measurement made in step 302 in FIG. 5, where the sound pressure level vs. frequency response was detected in the test coupler 100, yielding the sound pressure level at the eardrum 30 (FIG. 9, steps 324-326).

Alternative Models for the Ear Canal

Figure 10:
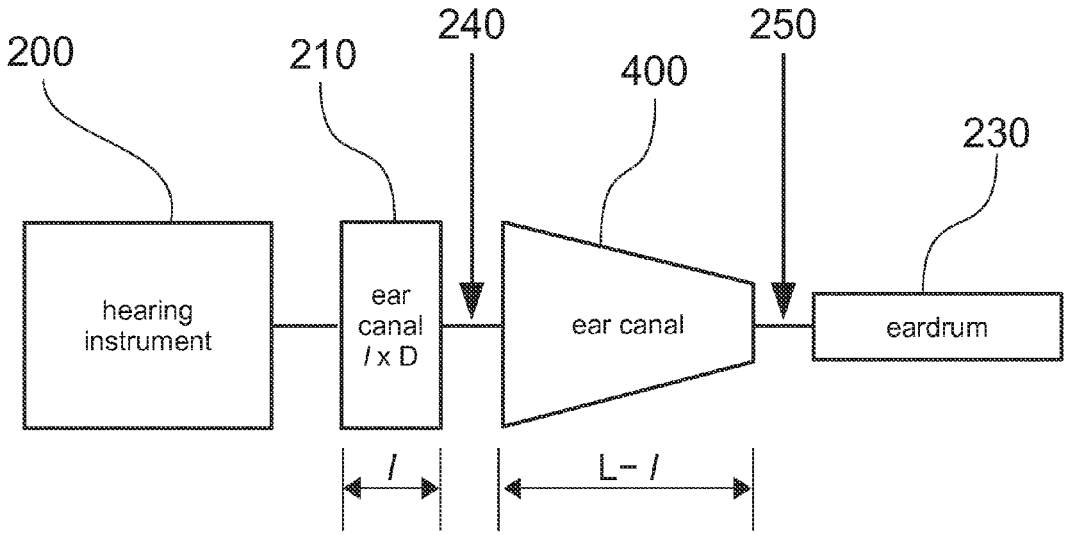
FIGS. 10-12 illustrate alternative geometries for models of the ear canal.
Figure 11:
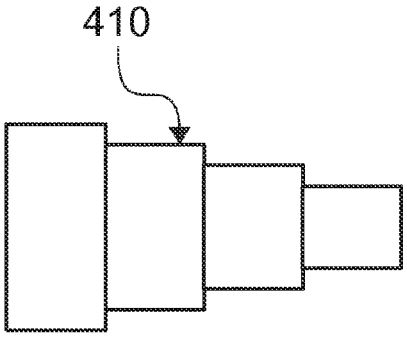
Figure 12:
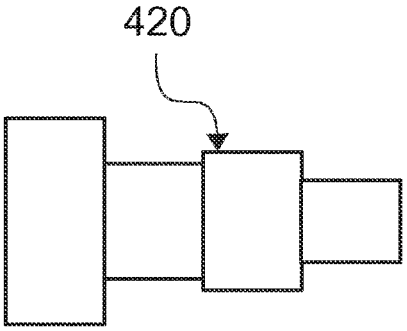

To more closely approximate the geometry of a human ear canal, the ear canal model (segments 210, 220) may have a conical shape (FIG. 10, 400), tapering towards the eardrum 230, or may be stepped in a series of sections of decreasing or varying diameter (FIG. 11, 410; FIG. 12, 420; respectively).

What is claimed is:

1. A method for acoustically fitting a hearing instrument positioned in an ear canal, the hearing instrument comprising a tip and a sound tube comprising an end at the tip of the hearing instrument, comprising:

measuring the sound pressure level at a predetermined distance from the end of the sound tube of the hearing instrument positioned in the ear canal;

measuring the sound pressure level at the predetermined distance from the end of the sound tube of the hearing instrument positioned in a test coupler;

in response to measuring the sound pressure level in the ear canal and the test coupler, determining a measured real-ear-to-coupler difference at the predetermined distance from the end of the hearing instrument sound tube, where determining comprises calculating the difference between the measured sound pressure level in the ear canal and the measured sound pressure level in the test coupler;

simulating the sound pressure level at the predetermined distance from a model of a hearing instrument positioned in a model of the ear canal, where the ear canal model comprises a length and a diameter;

simulating the sound pressure level at the predetermined distance from the model of a hearing instrument positioned in a model of the test coupler;

in response to simulating the sound pressure level in the ear canal and the test coupler, determining a simulated real-ear-to-coupler difference at the predetermined distance from the model of a hearing instrument, where determining comprises calculating the difference between the simulated sound pressure level in the ear canal and the simulated sound pressure level in the test coupler;

optimizing the model of the ear canal, comprising (a) varying the length and/or diameter of the model of the ear canal;

(b) simulating the sound pressure level at the predetermined distance from the model of the hearing instrument positioned in the model of the ear canal comprising a varied length and/or diameter;

(c) determining the simulated real-ear-to-coupler difference at the predetermined distance from the model of the hearing instrument positioned in the model of the ear canal comprising a varied length and/or diameter, where determining comprises calculating the difference between the simulated sound pressure level in the ear canal and the simulated sound pressure level in the test coupler;

(d) determining the error between the measured real-ear-to-coupler difference at the predetermined distance from the hearing instrument and the simulated real-ear-to-coupler difference at the predetermined distance from the model of the hearing instrument; and iteratively repeating preceding steps (a) though (d) until the error is minimized to a predetermined, acceptable amount, yielding optimized values of length and diameter for the ear canal model;

simulating the sound pressure level at the eardrum generated by a model of the hearing instrument in the model of the ear canal comprising the optimized values of length and/or diameter; and determining the optimized simulated real-ear-to-coupler difference at the eardrum, where determining comprises calculating the difference between the optimized simulated sound pressure level and the simulated sound pressure level in the test coupler.

2. A method as set forth in claim 1, further comprising adding the optimized simulated real-ear-to-coupler difference at the eardrum to the sound pressure level measured in the test coupler.

3. A method as set forth in claim 1, where the sound pressure level is measured and simulated over a range of frequencies $f_1$-$f_2$.

4. A method as set forth in claim 1, where measuring the sound pressure level at a distance from a hearing instrument positioned in the ear canal comprises measuring the sound pressure level at a distance of 5 mm from the end of the hearing instrument sound tube.

5. A method as set forth in claim 1, where measuring the sound pressure level at a predetermined distance from the hearing instrument positioned in a test coupler comprises measuring the sound pressure level in a test coupler comprising a volume of 0.4 cc.

6. A method as set forth in claim 1, where the model of the ear canal comprises a taper from the hearing instrument towards the eardrum.

7. A method as set forth in claim 1, where the model of the ear canal comprises a plurality of sections of decreasing diameter.

8. A method as set forth in claim 1, where the model of the ear canal comprises a plurality of sections of varying diameter.

9. A method for creating an optimized model of an ear canal for a hearing instrument positioned in the ear canal, the hearing instrument comprising a tip and a sound tube comprising an end at the tip of the hearing instrument, comprising:

measuring the sound pressure level at a predetermined distance from the end of the sound tube of a hearing instrument positioned in the ear canal;

measuring the sound pressure level at the predetermined distance from the end of the sound tube of the hearing instrument positioned in a test coupler;

in response to measuring the sound pressure level in the ear canal and the test coupler, determining a measured real-ear-to-coupler difference at the predetermined distance from the end of the hearing instrument sound tube, where determining comprises calculating the difference between the sound pressure level measured in the ear canal and the sound pressure level measured in the test coupler;

simulating the sound pressure level at the predetermined distance from a model of a hearing instrument positioned in a model of the ear canal, where the ear canal model comprises a length and a diameter;

simulating the sound pressure level at the predetermined distance from the model of a hearing instrument positioned in a model of the test coupler;

in response to simulating the sound pressure level in the ear canal and the test coupler, determining a simulated real-ear-to-coupler difference at the predetermined distance from the model of a hearing instrument, where determining comprises calculating the difference between the simulated sound pressure level in the ear canal and the simulated sound pressure level in the test coupler; and optimizing the model of the ear canal, comprising (a) varying the length and/or diameter of the model of the ear canal;

(b) simulating the sound pressure level at the predetermined distance from the model of the hearing instrument positioned in the model of the ear canal comprising the varied length and/or diameter;

(c) determining the simulated real-ear-to-coupler difference at the predetermined distance from the model of the hearing instrument positioned in the model of the ear canal comprising a varied length and/or diameter, where determining comprises calculating the difference between the simulated sound pressure level in the ear canal and the simulated sound pressure level in the test coupler;

(d) determining the error between the measured real-ear-to-coupler difference at the predetermined distance from the hearing instrument and the simulated real-ear-to-coupler difference at the predetermined distance from the model of the hearing instrument; and iteratively repeating preceding steps (a) though (d) until the error is minimized, yielding optimized values of length and diameter for the ear canal model.

10. A method for acoustically fitting a hearing instrument positioned in an ear canal, the hearing instrument comprising a tip and a sound tube comprising an end at the tip of the hearing instrument, comprising:

calculating a measured real-ear-to-coupler difference at a predetermined distance from the end of the hearing instrument sound tube, based upon the difference between the sound pressure level measured in the ear canal at the predetermined distance and the sound pressure level measured in the test coupler;

calculating a simulated real-ear-to-coupler difference at the predetermined distance from the end of the hearing instrument sound tube, based upon the difference between the sound pressure level simulated in a model of the ear canal, comprising a length and a diameter, at the predetermined distance and the sound pressure level simulated in the test coupler;

optimizing the model of the ear canal, comprising (a) determining the simulated real-ear-to-coupler difference at the predetermined distance from the model of the hearing instrument positioned in the model of the ear canal comprising a varied length and/or diameter, based upon the sound pressure level simulated at the predetermined distance from the model of the hearing instrument positioned in the model of the ear canal comprising a varied length and/or diameter;

(b) determining the error between the measured real-ear-to-coupler difference at the predetermined distance from the hearing instrument and the simulated real-ear-to-coupler difference at the predetermined distance from the model of the hearing instrument; and iteratively repeating preceding steps (a) and (b) until the error is minimized, yielding optimized values of length and diameter for the ear canal model; and calculating an optimized simulated real-ear-to-coupler difference at the eardrum, based upon the difference between the sound pressure level simulated at the eardrum generated by a model of the hearing instrument in the model of the ear canal comprising the optimized values of length and/or diameter, and the sound pressure level simulated in the test coupler.

11. A method as set forth in claim 10, further comprising adding the optimized simulated real-ear-to-coupler difference at the eardrum to the sound pressure level measured in the test coupler.

12. A method for acoustically fitting a hearing instrument positioned in an ear canal, the hearing instrument comprising a tip and a sound tube comprising an end at the tip of the hearing instrument, comprising:

measuring the real-ear-to-coupler difference in the ear canal at a predetermined distance from the end of the hearing instrument sound tube;

simulating the real-ear-to-coupler difference at the predetermined distance from the end of a model of the hearing instrument in a model of the ear canal comprising a length and a diameter;

selecting values for the length and diameter of the model of the ear canal such that the differences between the measured and simulated real-ear-to-coupler differences at the predetermined distance are minimized to a predetermined level.

13. A method as set forth in claim 12, further comprising calculating the simulated real-ear-to-coupler difference at the eardrum.

14. A method as set forth in claim 13, further comprising calculating the sound pressure frequency response at the eardrum.

* * * * *